US010720744B2

(12) United States Patent
Sudou et al.

(10) Patent No.: US 10,720,744 B2
(45) Date of Patent: Jul. 21, 2020

(54) HEAT-SHRINKABLE TUBE FITTING JIG AND METHOD FOR MANUFACTURING ELECTRIC WIRE WITH HEAT-SHRINKABLE TUBE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroshi Sudou, Mie (JP); Hayato Aoi, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 127 days.

(21) Appl. No.: 15/558,841

(22) PCT Filed: Mar. 2, 2016

(86) PCT No.: PCT/JP2016/056346
§ 371 (c)(1),
(2) Date: Sep. 15, 2017

(87) PCT Pub. No.: WO2016/152411
PCT Pub. Date: Sep. 29, 2016

(65) Prior Publication Data

US 2018/0069364 A1 Mar. 8, 2018

(30) Foreign Application Priority Data

Mar. 23, 2015 (JP) ..... 2015-059067

(51) Int. Cl.
*H01R 43/20* (2006.01)
*H01R 43/00* (2006.01)
(Continued)

(52) U.S. Cl.
CPC ..... *H01R 43/20* (2013.01); *H01R 4/185* (2013.01); *H01R 4/72* (2013.01); *H01R 11/12* (2013.01); *H01R 43/005* (2013.01)

(58) Field of Classification Search
CPC ..... H01R 43/00; H01R 43/20; H01R 4/18; H01R 4/72; H01R 4/185; H01R 11/12; Y10T 29/53126; Y10T 29/53209
(Continued)

(56) References Cited

U.S. PATENT DOCUMENTS 6,035,517 A * 3/2000 Moore ..... H01R 43/28 174/481
7,174,633 B2 * 2/2007 Onuma ..... H01R 4/04 29/854
(Continued)

FOREIGN PATENT DOCUMENTS

JP 2006261065 A 9/2006
JP 2013114936 A 6/2013
JP 2016009680 A 1/2016

OTHER PUBLICATIONS

International Search Report for application PCT/JP2016/056346 dated Apr. 5, 2016; 5 pages.

*Primary Examiner* — Peter Dungba Vo
*Assistant Examiner* — Kaying Kue
(74) *Attorney, Agent, or Firm* — Reising Ethington, P.C.

(57) ABSTRACT

A heat-shrinkable tube fitting jig is used to fit a heat-shrinkable tube onto a terminal-attached electric wire formed by crimping a core wire crimp portion of a terminal onto a core wire of an electric wire. The heat-shrinkable tube
(Continued)

fitting jig is provided with a first side abutting plate, a second side abutting plate member, and an electric wire holding portion. Columnar bodies and recessed surfaces, which constitute terminal positioning portions, are provided on the upper surface of the first side abutting plate. A first side end face and a second side end face of the heat-shrinkable tube are abutted against mutually opposing surfaces (a first side abutting surface 40S and a second side abutting surface 44S) of the first side abutting plate and the second side abutting plate.

8 Claims, 7 Drawing Sheets

(51) Int. Cl.
*H01R 4/18* (2006.01)
*H01R 4/72* (2006.01)
*H01R 11/12* (2006.01)

(58) Field of Classification Search
USPC ..... 29/747, 728, 748–754, 859, 858, 857, 29/874, 883, 885
See application file for complete search history.

(56) References Cited

U.S. PATENT DOCUMENTS

| | | | | |
|---|---|---|---|---|
| 8,261,441 | B1 * | 9/2012 | Carlsten | H02G 1/16 29/825 |
| 9,954,290 | B2 * | 4/2018 | Sudou | H01R 4/72 |
| 10,069,220 | B2 * | 9/2018 | Sudou | H01R 4/18 |
| 2005/0095892 | A1 * | 5/2005 | Fukuyama | H01R 4/72 439/287 |
| 2010/0178800 | A1 * | 7/2010 | Clausen | H01R 9/0524 439/583 |
| 2011/0048762 | A1 * | 3/2011 | Sawamura | B60R 16/0207 174/78 |
| 2011/0070781 | A1 * | 3/2011 | Kitagawa | H01R 4/185 439/877 |
| 2013/0126234 | A1 * | 5/2013 | Ono | H01R 4/72 174/75 R |
| 2013/0175088 | A1 * | 7/2013 | Itou | H01R 43/005 174/74 R |
| 2014/0230996 | A1 | 8/2014 | Saito | |
| 2015/0111442 | A1 * | 4/2015 | Miyamoto | H01R 4/62 439/874 |

* cited by examiner

*Figure 1*
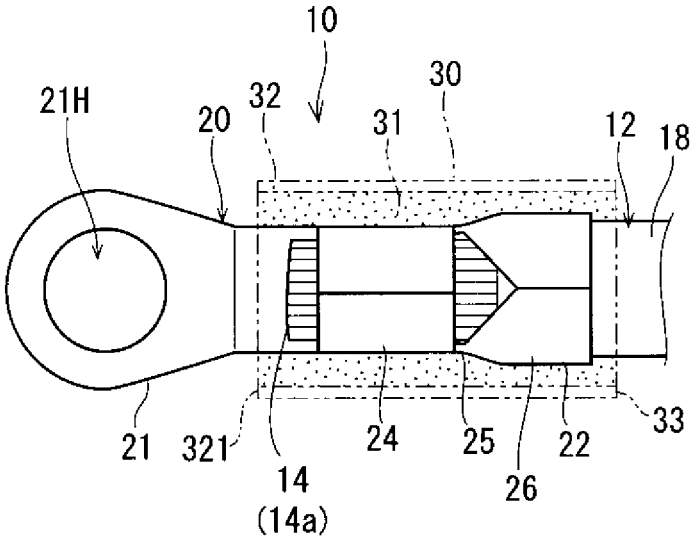
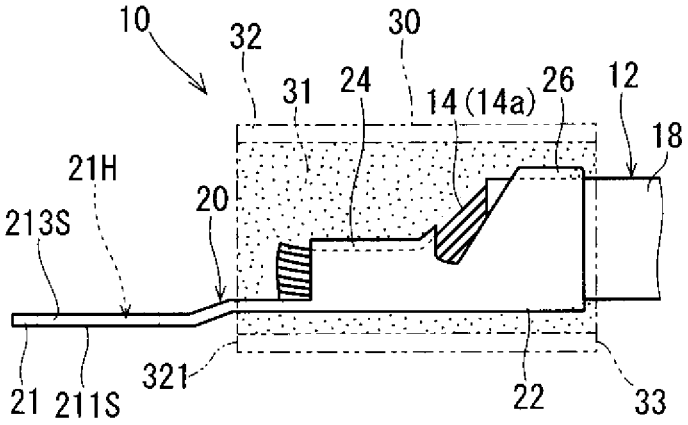
*Figure 2*

HEAT-SHRINKABLE TUBE FITTING JIG AND METHOD FOR MANUFACTURING ELECTRIC WIRE WITH HEAT-SHRINKABLE TUBE

CROSS REFERENCE TO RELATED APPLICATIONS

This application claims the priority of Japanese patent application JP2015-059067 filed on Mar. 23, 2015, the entire contents of which are incorporated herein.

TECHNICAL FIELD

The present invention relates to technology for fitting a heat-shrinkable tube onto a terminal-attached electric wire.

BACKGROUND ART

Patent Document 1 and Patent Document 2 disclose techniques for, when fitting a heat-shrinkable tube onto a connecting portion between an electric wire and a terminal, preventing the hot melt provided inside the heat-shrinkable tube from running over to the counterpart connecting portion of the terminal.

Patent Document 1 (JP2006-261065A) discloses an earth terminal holder that includes a base body for receiving an earth terminal whose crimp connecting portion crimped to a wire harness is covered with a hot melt heat-shrinkable tube, a holding means capable of opening and closing relative to the base body to press and hold down the earth terminal received in the base body, and an opening-and-closing means for opening and closing the holding means in the direction in which the earth terminal is inserted. The holding means continuously presses the earth terminal as a result of screwing a screw shaft into a threaded hole formed in the base body to hold down a presser plate, which is the holding means.

Additionally, Patent Document 2 (JP2013-114936A) discloses a method of attaching a heat-shrinkable tube, comprising the steps of fitting a terminal into a terminal fitting recess in a lower frame, fitting a heat-shrinkable tube that contains hot melt onto a core wire crimp portion of the terminal that extends outward from the lower frame so that one end of the tube abuts against a flood wall of the lower frame, placing an upper frame connected to the lower frame over the terminal fitting recess, and causing a clamp lever provided on a base to clamp the lower frame and the upper frame together.

SUMMARY

According to Patent Document 1 and Patent Document 2, however, only one of the two ends of a heat-shrinkable tube at which the terminal is exposed is held down, thus potentially allowing the tube to move in the direction in which the electric wire extends. In this way, there is a chance that the attachment of the heat-shrinkable tube may become defective due to displacement of the heat-shrinkable tube with respect to the terminal-attached electric wire.

Accordingly, an object of the present design is to provide a technique for accurately positioning a heat-shrinkable tube with respect to a terminal-attached electric wire.

In order to solve the above-described problem, a first aspect is directed to a heat-shrinkable tube fitting jig used to fit a heat-shrinkable tube onto a terminal-attached electric wire in which a core wire crimp portion of a terminal is crimped onto an exposed core wire portion exposed from an electric wire, including: a terminal positioning portion for positioning a counterpart connecting portion of a terminal of the terminal-attached electric wire, the terminal extending out of a first end of the heat-shrinkable tube; a first end face abutting portion that abuts against a first end face of the heat-shrinkable tube that faces the counterpart connecting portion; and a second end face abutting portion that abuts against a second end face of the heat-shrinkable tube that is opposite to the first end face.

Additionally, a second aspect is directed to a heat-shrinkable tube fitting jig according to the first aspect, wherein the first end face abutting portion closes at least a part of a gap between the heat-shrinkable tube and the terminal by abutting against the terminal from one of two main surfaces of the counterpart connecting portion and also against the first end face of the heat-shrinkable tube.

Furthermore, a third aspect is directed to a heat-shrinkable tube fitting jig according to the first or second aspect, wherein the terminal positioning portion includes a columnar body erected on a plate member and capable of passing through a through hole formed in the counterpart connecting portion.

Moreover, a fourth aspect is directed to a heat-shrinkable tube fitting jig according to the third aspect, wherein the terminal positioning portion includes a pair of circumferential surface abutting portions erected on the plate portion and abutting against a circumferential surface of the counterpart connecting portion, at a position where the circumferential surface abutting portions pinch the counterpart connecting portion of the terminal.

In addition, a fifth aspect is directed to a heat-shrinkable tube fitting jig according to the third or fourth aspect, wherein the terminal positioning portion includes a recessed surface formed in the plate member, and the recessed surface includes a bottom surface that abuts against one of the two main surfaces of the counterpart connecting portion of the terminal, and an inner surface that abuts against a circumferential surface of the counterpart connecting portion of the terminal, the inner surface being a surface rising from the bottom surface.

Further, a sixth aspect is directed to a heat-shrinkable tube fitting jig according to any one of the first to fifth aspects, further including a hold-down member for holding down a first side end of the heat-shrinkable tube that is located on the counterpart connecting portion side.

Furthermore, a seventh aspect is directed to a heat-shrinkable tube fitting jig according to the sixth aspect, wherein at least a part of the hold-down member that comes into contact with the first side end includes an acetal resin or fluororesin.

Furthermore, an eighth aspect is directed to a heat-shrinkable tube fitting jig according to any one of the first to seventh aspects, further including an electric wire holding portion for holding an electric wire that extends from a second end of the heat-shrinkable tube.

Furthermore, a ninth aspect is directed to a heat-shrinkable tube fitting jig according to any one of the first to eighth aspects, wherein a plurality of the terminal positioning portions are formed in parallel on a single component.

Further, a tenth aspect is directed to a method of manufacturing an electric wire with a heat-shrinkable tube using the heat-shrinkable tube fitting jig according to any one of the first to ninth aspects, the including the steps of: (a) preparing a terminal-attached electric wire passed through a heat-shrinkable tube; (b) abutting the first end face of the heat-shrinkable tube against the first end face abutting portion; and (c) abutting the second end face of the heat-shrinkable tube against the second end face abutting portion.

According to the first to tenth aspects, the first end face and the second end face of the heat-shrinkable tube can be restrained by the first end face abutting portion and the second end face abutting portion. This allows for control of the positions of both end faces of the heat-shrinkable tube. Accordingly, the heat-shrinkable tube can be more reliably positioned with respect to the terminal-attached electric wire positioned by the terminal positioning portion.

Additionally, according to the second aspect, due to the first end face abutting portion closing at least a part of the gap between the heat-shrinkable tube and the terminal when the heat-shrinkable tube is heated and shrunk, it is possible to reduce the leakage of the adhesive provided inside the heat-shrinkable tube out of the gap and its advance to the counterpart terminal.

Furthermore, according to the third aspect, the terminal can be easily positioned by passing the columnar body through the through hole of the counterpart connecting portion.

Furthermore, according to the fourth aspect, the pair of circumferential surface abutting portions can pinch a counterpart connecting portion to prevent rotation of the counterpart connecting portion after being fitted on the columnar body. In this way, the terminal-attached electric wire can be prevented from rotating.

Furthermore, according to the fifth aspect, the counterpart terminal can be prevented from rotating by setting the counterpart terminal in the recessed surface after being fitted onto the columnar body. In this way, the terminal can be prevented from rotating.

Furthermore, according to the sixth aspect, because the first end face of the heat-shrinkable tube can be held down, the heat-shrinkable tube can be more properly positioned.

Furthermore, according to the seventh aspect, the adhesive leaking out of the heat-shrinkable tube can be prevented from adhering to the hold-down member.

Furthermore, according to the eighth aspect, the electric wire portion can be held down by the electric wire holding portion while positioning the terminal portion of the terminal-attached electric wire in the terminal positioning portion. This ensures that the terminal-attached electric wire can be more reliably held in a fixed position.

Moreover, according to the heat-shrinkable tube fitting jig of the ninth aspect, the terminals of a plurality of terminal-attached electric wires can be positioned. This allows for efficient fitting of heat-shrinkable tubes onto a plurality of terminal-attached electric wires.

BRIEF DESCRIPTION OF DRAWINGS

FIG. 1 is a schematic top view showing a terminal-attached electric wire according to a first embodiment.

FIG. 2 is a schematic side view showing the terminal-attached electric wire according to the first embodiment.

DESCRIPTION OF EMBODIMENTS

Figure 3:
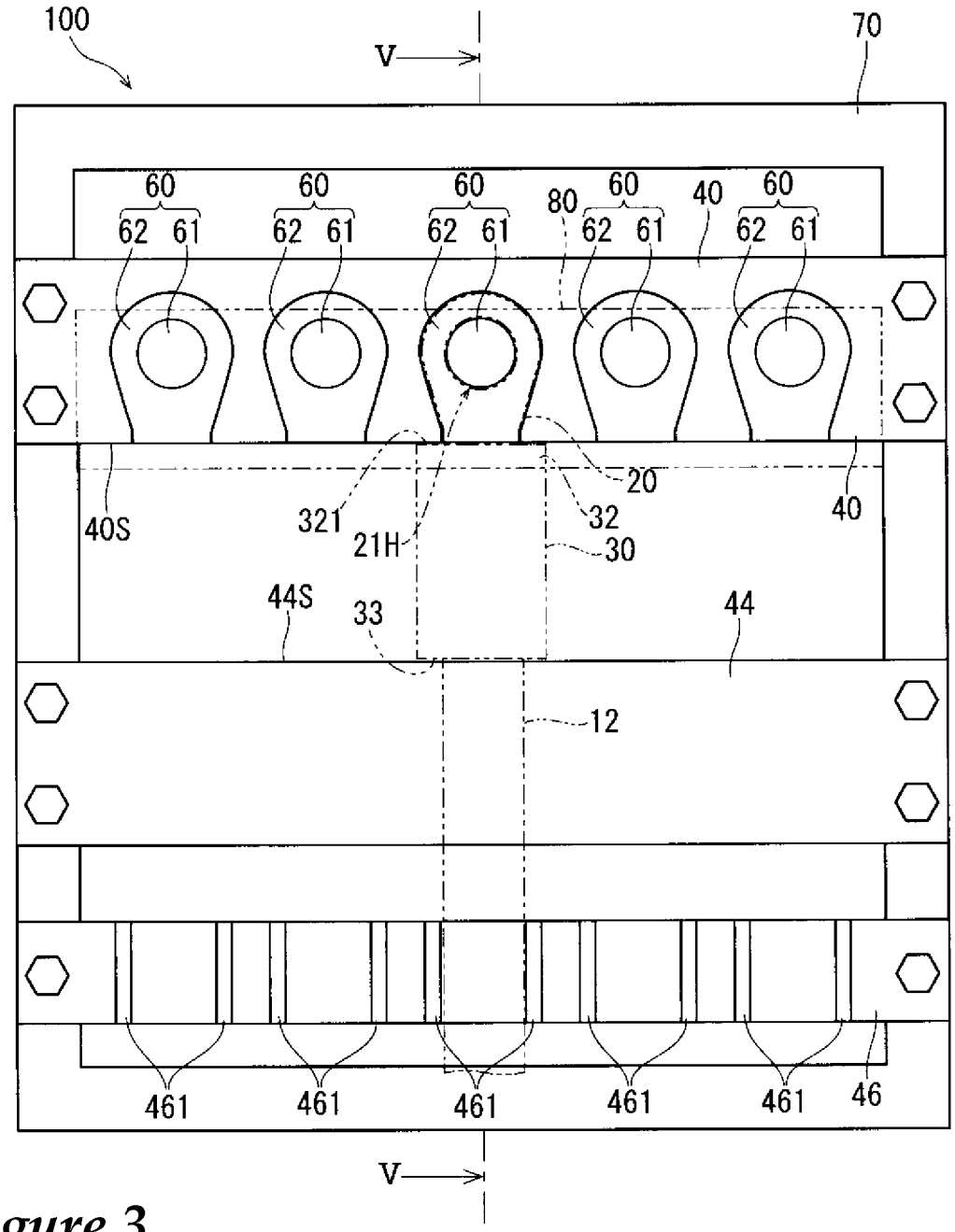
FIG. 3 is a schematic top view showing a heat-shrinkable tube fitting jig according to the first embodiment.

Embodiments of the present invention will be described hereinafter with reference to the attached drawings. It should be noted that the components described in the embodiments are provided for the purpose of illustration only and not intended to limit the scope of the invention to these components. Furthermore, in the drawings, the dimensions and the numbers of certain parts may be exaggerated or simplified as required to facilitate comprehension.

First Embodiment

FIG. 1 is a schematic top view showing a terminal-attached electric wire 10 according to a first embodiment. FIG. 2 is a schematic side view showing the terminal-attached electric wire 10 according to the first embodiment. As shown in FIGS. 1 and 2, the terminal-attached electric wire 10 is provided with an electric wire 12 and a terminal 20.

The electric wire 12 is provided with a core wire 14 and a sheath 18 that covers the core wire 14. The core wire 14 is a linear conductor formed, for example, by twisting together a plurality of element wires. The sheath 18 is made of an insulating material, such as resin. The sheath 18 is formed, for example, by performing extrusion coating of a softened resin around the core wire 14.

Furthermore, a predetermined length of the sheath 18 is stripped from the core wire 14 on one end of the electric wire 12. This provides an exposed core wire portion 14*a* at which the predetermined length of the core wire 14 is exposed from one end of the electric wire 12.

The terminal 20 is a member formed by stamping a metal plate material, which is a conductive plate material. The terminal 20 is formed as an earth terminal that has an earth portion 21 with a through hole 21H formed therein through which a bolt is passed and an electric wire holding portion 22 that is continuous with the earth portion 21. The earth portion 21 is one example of a counterpart connecting portion.

The electric wire holding portion 22 is provided with a core wire crimp portion 24 and a sheath crimp portion 26. These portions are formed linearly with respect to each other along a straight line. It should be noted that, in the terminal 20, the earth portion 21 of the terminal 20 is regarded as the distal end while the electric wire holding portion 22 is regarded as the proximal end of the terminal 20.

The core wire crimp portion 24 is a portion crimped onto the exposed core wire portion 14*a* through crimping. The sheath crimp portion 26 is the portion crimped onto the end of the sheath 18 of the electric wire 12 through crimping.

When performing water-proofing, a heat-shrinkable tube fitting jig 100, which will be described below, is used to fit a heat-shrinkable tube 30 onto the terminal-attached electric wire 10, which is constructed as described above. The heat-shrinkable tube 30 has hot melt 31, which acts as an adhesive, adhering to the inner side thereof. As shown in FIGS. 1 and 2, water-proofing involves setting the heat-shrinkable tube 30 onto the electric wire 12 to surround the exposed core wire portion 14*a*. Subsequently, as a result of being heated using a heating apparatus, the heat-shrinkable tube 30 shrinks while the hot melt 31 inside permeates into the core wire crimp portion 24, etc. This allows the heat-shrinkable tube 30 to be fitted onto the terminal-attached electric wire 10 and to make it water proof.

The following is a detailed description of the configuration of the heat-shrinkable tube fitting jig 100. In the following description, the side of the heat-shrinkable tube 30 from which the terminal 20 is exposed will be referred to as the first side and the side from which the electric wire 12 extends will be referred to as the second side.

FIG. 3 is a schematic top view showing the heat-shrinkable tube fitting jig 100 according to the first embodiment. The heat-shrinkable tube fitting jig 100 is provided with a first side abutting plate 40, a second side abutting plate 44, and an electric wire holding portion 46. The first side abutting plate 40, the second side abutting plate 44, and the electric wire holding portion 46 are integrated with one another by having both ends thereof secured to a rectangular frame body 70 using a plurality of bolts.

Figure 4:
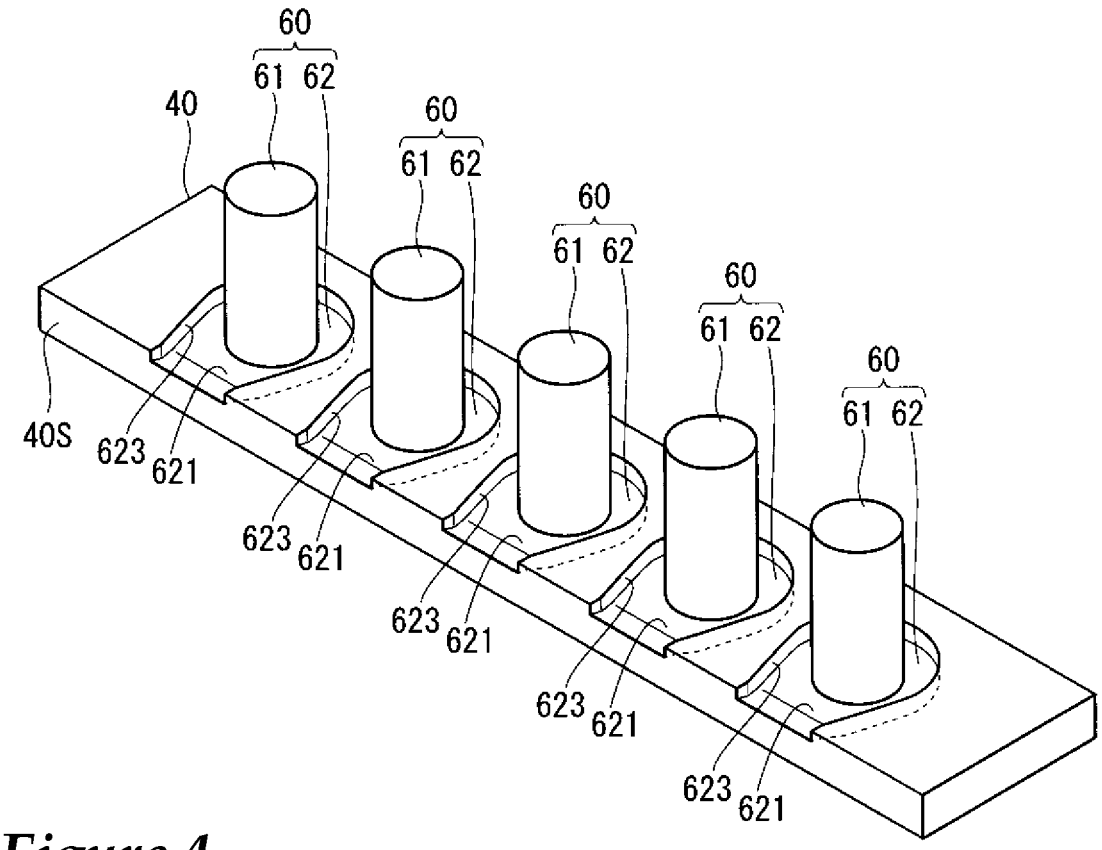
FIG. 4 is a schematic perspective view showing a first side abutting plate of the heat-shrinkable tube fitting jig according to the first embodiment.
Figure 5:
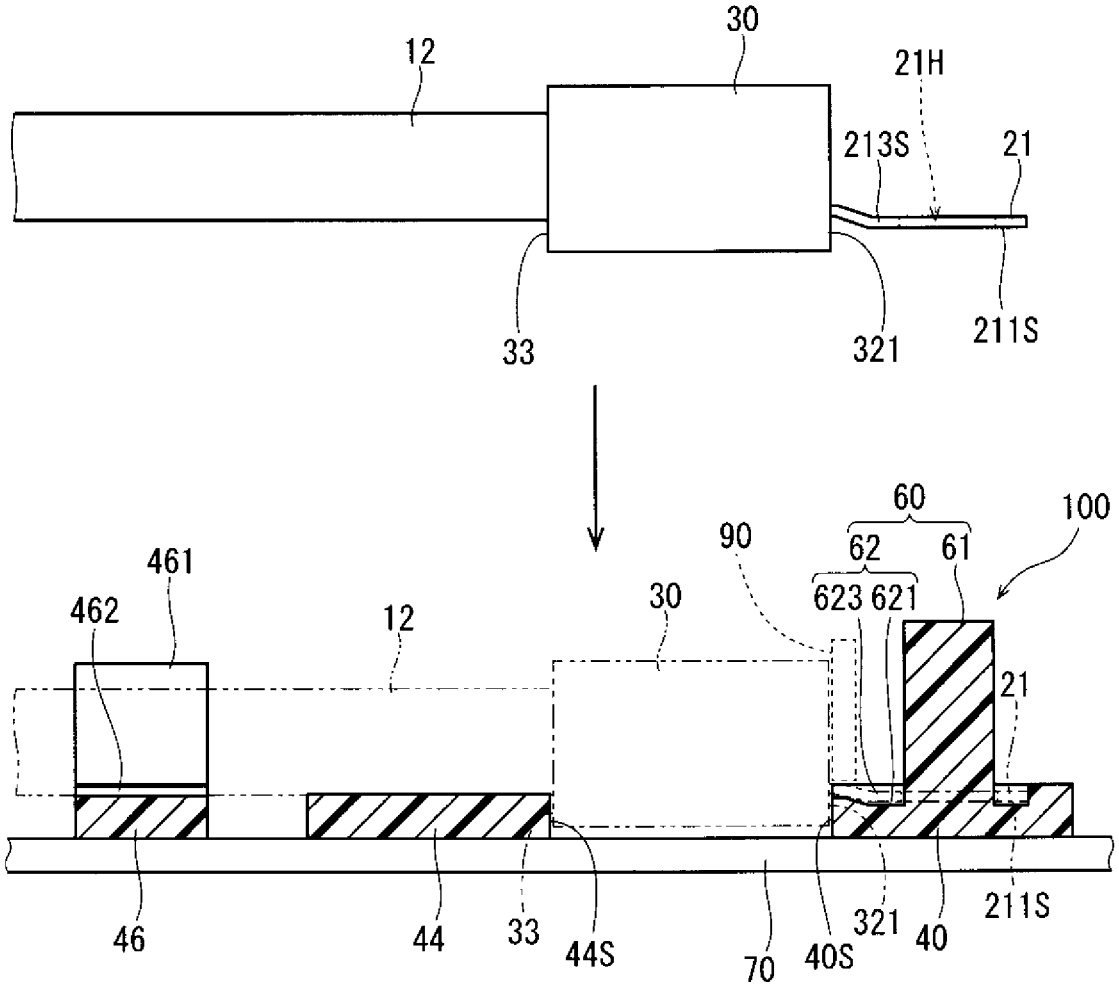
FIG. 5 is a schematic cross-sectional view showing the heat-shrinkable tube fitting jig taken along line V-V of FIG. 3.

FIG. 4 is a schematic perspective view showing the first side abutting plate 40 of the heat-shrinkable tube fitting jig 100 according to the first embodiment. FIG. 5 is a schematic cross-sectional view showing the heat-shrinkable tube fitting jig 100 taken along line V-V in FIG. 3. It should be noted that FIG. 5 shows how the terminal-attached electric wire 10, which is passed through the heat-shrinkable tube 30, is secured to the heat-shrinkable tube fitting jig 100.

The first side abutting plate 40 is a plate-shaped member made of a fluororesin (e.g., Teflon®), for example. The first side abutting plate 40 has a first side abutting surface 40S against which a first end face 321 (the one of the two end faces of the heat-shrinkable tube 30 on which the earth portion 21 of the terminal 20 is exposed) of the heat-shrinkable tube 30 abuts. The first side abutting plate 40 is one example of a first end face abutting portion that abuts against the first end face 321 of the heat-shrinkable tube 30.

It should be noted that the entire first side abutting plate 40 need not be made of a fluororesin. A portion of the first side abutting plate 40 may be made of a fluororesin, for example, where it abuts against the first end face 321, such as the first side abutting surface 40S thereof.

Furthermore, an acetal resin (polyacetal) may also be used instead of a fluororesin.

A plurality of terminal positioning portions 60 for positioning the terminals 20 of the terminal-attached electric wires 10 are formed in parallel on the first side abutting plate 40. Each of the terminal positioning portions 60 is provided with a columnar body 61 and a recessed surface 62.

The columnar body 61 is erected on the upper surface of the first side abutting plate 40 and has a shape capable of passing through the through hole 21H of the earth portion 21 of the terminal 20. The columnar body 61 limits the movement of the earth portion 21 by coming into contact with the inner surface of the through hole 21H. This facilitates the positioning of the terminal 20.

The recessed surface 62 is formed in the upper surface of the first side abutting plate 40. The recessed surface 62 has a shape that matches the outer shape of the earth portion 21 of the terminal 20 and is formed to allow the earth portion 21 to be fitted therein.

The recessed surface 62 includes a bottom surface 621 and an inner surface 623 rising from the bottom surface 621. The bottom surface 621 abuts against a lower surface 211S, which is one of the two main surfaces of the earth portion 21 of the terminal 20, (the main surface opposite to where the core wire crimp portion 24 is formed). Additionally, the inner surface 623 abuts against a circumferential surface 213S of the earth portion 21. The circumferential surface 213S of the earth portion 21 is abutted against the inner surface 623 as a result of the earth portion 21 being fitted in the recessed surface 62. This prevents the terminal 20 from rotating. Accordingly, the terminal-attached electric wire 10 can be more reliably held in a fixed position.

The bottom surface 621, which partially forms the upper surface of the first side abutting plate 40, abuts against the lower surface 211S, which is one of the main surfaces of the earth portion 21. Moreover, due to the first side abutting surface 40S of the first side abutting plate 40 abutting against the first end face 321 of the heat-shrinkable tube 30, at least a part of the gap between the heat-shrinkable tube 30 and the lower surface 211S is closed. In this way, the first side abutting surface 40S can reduce the leakage of the hot melt 31 from the gap as it is melted when undergoing heat treatment. Accordingly, this can limit the advance of the hot melt 31 to the earth portion 21, i.e., the counterpart connecting portion.

The second side abutting plate 44 has a second side abutting surface 44S that opposes the first side abutting surface 40S of the first side abutting plate 40. The second side abutting surface 44S abuts against a second end face 33 of the heat-shrinkable tube 30 opposite the first end face 321. The first side abutting surface 40S and the second side abutting surface 44S are spaced apart by a length that corresponds to that of the length of the heat-shrinkable tube 30. The second side abutting plate 44 is one example of the second end face abutting portion.

The entire second side abutting plate 44 may be made of a fluororesin. However, part of it, such as the second side abutting surface 44S, which abuts against the second end face 33 of the heat-shrinkable tube 30, may be partially made of a fluororesin. It should be noted that, as shown in FIG. 3, the upper surface of the second side abutting plate 44 is a flat surface that supports the electric wire 12. If the electric wire 12 is supported on the second side abutting plate 44, it is desirable to form the second side abutting plate 44 using a material having low heat conductivity (for example, resin) in order to prevent overheating of the electric wire 12 during heat processing.

Figure 6:
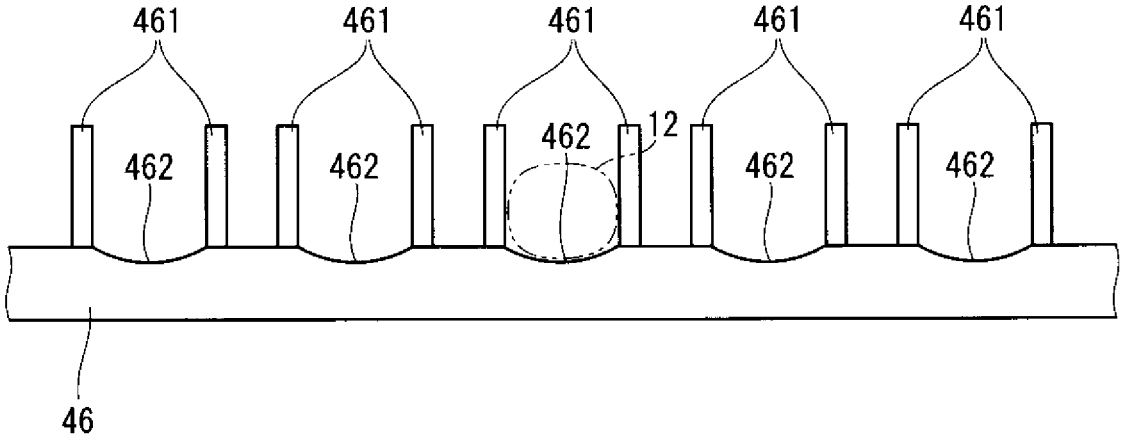
FIG. 6 is a schematic front view showing an electric wire holding portion according to the first embodiment.

FIG. 6 is a schematic front view showing an electric wire holding portion 46 according to the first embodiment. The electric wire holding portion 46 holds, at a position away from the terminal positioning portion 60, the electric wire 12, which extends to the second side from the heat-shrinkable tube 30. A pair of wire supporting protrusions 461 and a wire holding groove 462 are formed on the upper surface of the electric wire holding portion 46 at positions that correspond to those of each terminal positioning portion 60. The wire holding groove 462 is formed by concaving the portion between the pair of wire supporting protrusions 461 in the shape of an arc. The wire holding groove 462 has a width dimension that is the same as or greater (slightly larger) than the diameter dimension of the electric wire 12. In addition, the wire holding groove 462 is open upward. By inserting the electric wire 12 into the wire holding groove 463 through the upward opening of the wire holding groove 462, the electric wire 12 is held in the widthwise direction at a predetermined position.

It should be noted that the configuration for holding the electric wire 12 is not limited to the foregoing. For example, the pair of wire supporting protrusions 461 may be omitted. Furthermore, one of the pair of wire supporting protrusions 461 may be omitted while bending the top end of the other into an L-shape to oppose the upper surface of the electric wire holding portion 46. Then, the electric wire 12 may be pinched between the upper surface of the electric wire holding portion 46 and the L-shaped portion opposing the upper surface thereof.

Figure 7:
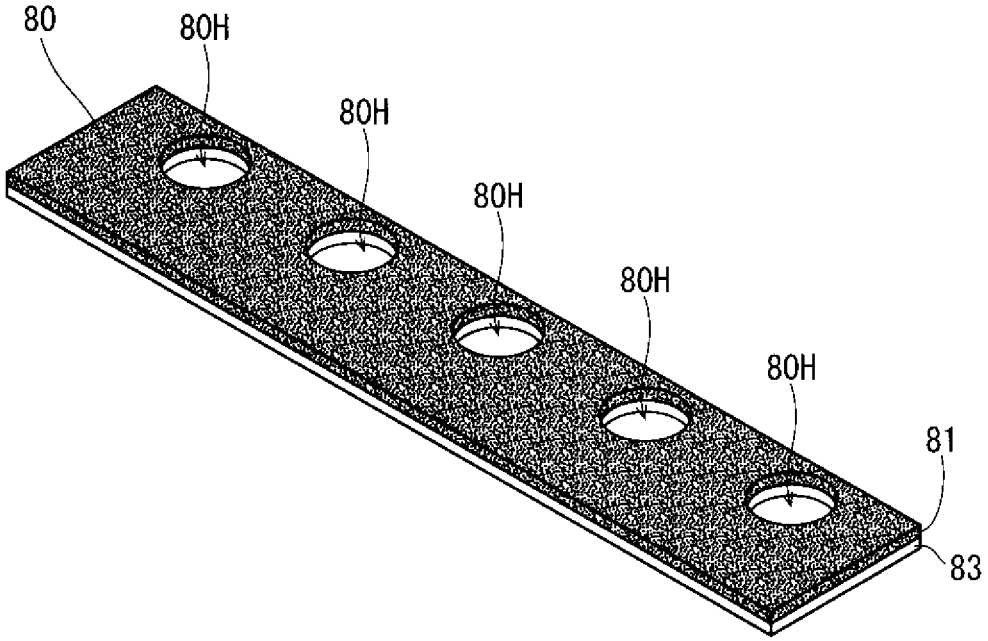
FIG. 7 is a schematic perspective view showing a hold-down member according to the first embodiment.
Figure 8:
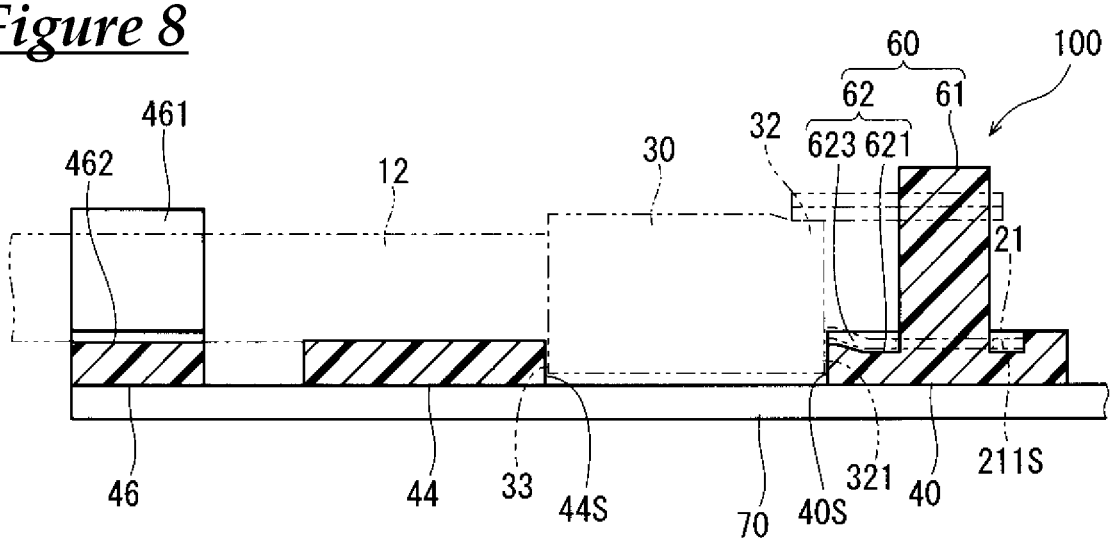
FIG. 8 is a schematic cross-sectional view showing the heat-shrinkable tube fitting jig according to the first embodiment.

FIG. 7 is a schematic perspective view that shows a hold-down member 80 according to the first embodiment. FIG. 8 is also a schematic cross-sectional view that shows the heat-shrinkable tube fitting jig 100 according to the first embodiment. It should be noted that FIG. 8 is a view that shows how the hold-down member 80 is set on the terminal-attached electric wire 10 as it is secured to the heat-shrinkable tube fitting jig 100 shown in FIG. 5.

As shown in FIG. 7, the hold-down member 80 is formed by affixing a steel sheet 81 to a fluororesin plate 83 (such as a Teflon plate). The hold-down member 80 has a plurality (five in this case) of through holes 80H formed therein. Each of the through holes 80H has a width dimension that is the same as or slightly larger than that of a columnar body 61. The hold-down member 80 is positioned by inserting each columnar body 61 through a through hole 80H.

As shown in FIG. 8, an edge portion of the hold-down member 80 is set on the first side end 32 of the heat-shrinkable tube 30. In other words, the hold-down member 80 is configured to cover the area from each columnar body 61 to the first side end 32 of each heat-shrinkable tube 30. With the hold-down member 80 set on the first side ends 32, the weight of the hold-down member 80 (mainly the weight of the steel plate 81) holds the upper portions of the first side ends 32 down on the terminal-attached electric wires 10. This makes it possible to hold the heat-shrinkable tubes 30 in their predetermined positions with respect to the terminal-attached electric wires 10.

Additionally, the face of the hold-down member 80 that abuts against the first side ends 32 of heat-shrinkable tubes 30 is formed of a fluororesin plate 83. This can reduce the adherence of the hot melt 31 to the hold-down member 80 as it leaks out of the first side ends 32 of the heat-shrinkable tubes 30. It should be noted that the fluororesin plate 83 may be omitted from the hold-down member 80. In this case, the portion of the steel plate 81 that abuts against the first side ends 32 of the heat-shrinkable tubes 30 may be coated with fluororesin. The steel plate 81 of the hold-down member 80 may also be formed with any material other than steel. However, if made of a heavy metal such as steel, the hold-down member 80 can be formed to be thinner. Additionally, the fluororesin may be replaced with an acetal resin.

Manufacturing Method

The following is a detailed description of a process of manufacturing terminal-attached electric wires 10 that are water-proofed (i.e., electric wires provided with a heat-shrinkable tube 30) by using the heat-shrinkable tube fitting jig 100 to fit heat-shrinkable tubes onto the terminal-attached electric wires.

First, a plurality of terminal-attached electric wires 10 that have been inserted through heat-shrinkable tubes 30 are prepared as shown in FIGS. 1 and 2. The heat-shrinkable tubes 30 are positioned where they cover the portions of the terminal-attached electric wires 10 that are to be water-proofed (for example, the areas of the terminals 20 on and around the core wire crimp portions 24).

Subsequently, the through hole 21H of the earth portion 21 of the terminal 20 of each terminal-attached electric wire 10 is penetrated by the columnar body 61 of a terminal positioning portion 60 (see FIG. 5). This positions the terminals 20. The electric wire 12 of each terminal-attached electric wire 10 is inserted between a pair of wire supporting protrusions 461 and set in the wire holding groove 462. This allows each electric wire 12 to be held on the electric wire holding portion 46.

The first end face 321 of each heat-shrinkable tube 30 then abuts against the first side abutting surface 40S of the first side abutting plate 40. Additionally, the second end face 33 of each heat-shrinkable tube 30 abuts against the second side abutting surface 44S of the second side abutting plate 44. This controls the longitudinal position of each heat-shrinkable tube 30.

Furthermore, as shown in FIG. 8, a columnar body 61 is passed through each through hole 80H of the hold-down member 80 while an edge portion of the hold-down member 80 is placed on the first side end 32 of each heat-shrinkable tube 30. This holds the first side end 32 of each heat-shrinkable tube 30 on the terminal 20.

Heat treatment is performed on each heat-shrinkable tube 30 using a heating apparatus with the tube assembled to the heat-shrinkable tube fitting jig 100 in this manner. It should be noted that if a stationary-type heating apparatus is used, the heat-shrinkable tube fitting jig 100 and the terminal-attached electric wires 10 assembled to the heat-shrinkable tube fitting jig 100 are moved to the heating apparatus to perform heat treatment on the heat-shrinkable tubes 30. Alternatively, if a mobile heating apparatus is used, the heating apparatus is moved to the heat-shrinkable tube fitting jig 100 to perform heat treatment on the heat-shrinkable tubes 30.

As described above, according to the heat-shrinkable tube fitting jig 100, the first end faces 321 and the second end faces 33 of the heat-shrinkable tubes 30 can be retained by the first side abutting plate 40 and the second side abutting plate 44. In this way, the heat-shrinkable tubes 30 can be suitably positioned.

Moreover, according to the heat-shrinkable tube fitting jig 100, the terminals 20 of a plurality of terminal-attached electric wires 10 can be positioned by arranging a plurality of terminal positioning portions 60 in parallel. This allows for efficient fitting of heat-shrinkable tubes 30 onto the plurality of terminal-attached electric wires 10.

Second Embodiment

A second embodiment will be described hereinafter. It should be noted that in the description that follows, detailed description of the elements having identical functionality to that of the elements that have been described may be omitted by denoting these elements with identical numerical symbols or identical numerical symbols suffixed with an alphabetical letter.

Figure 9:
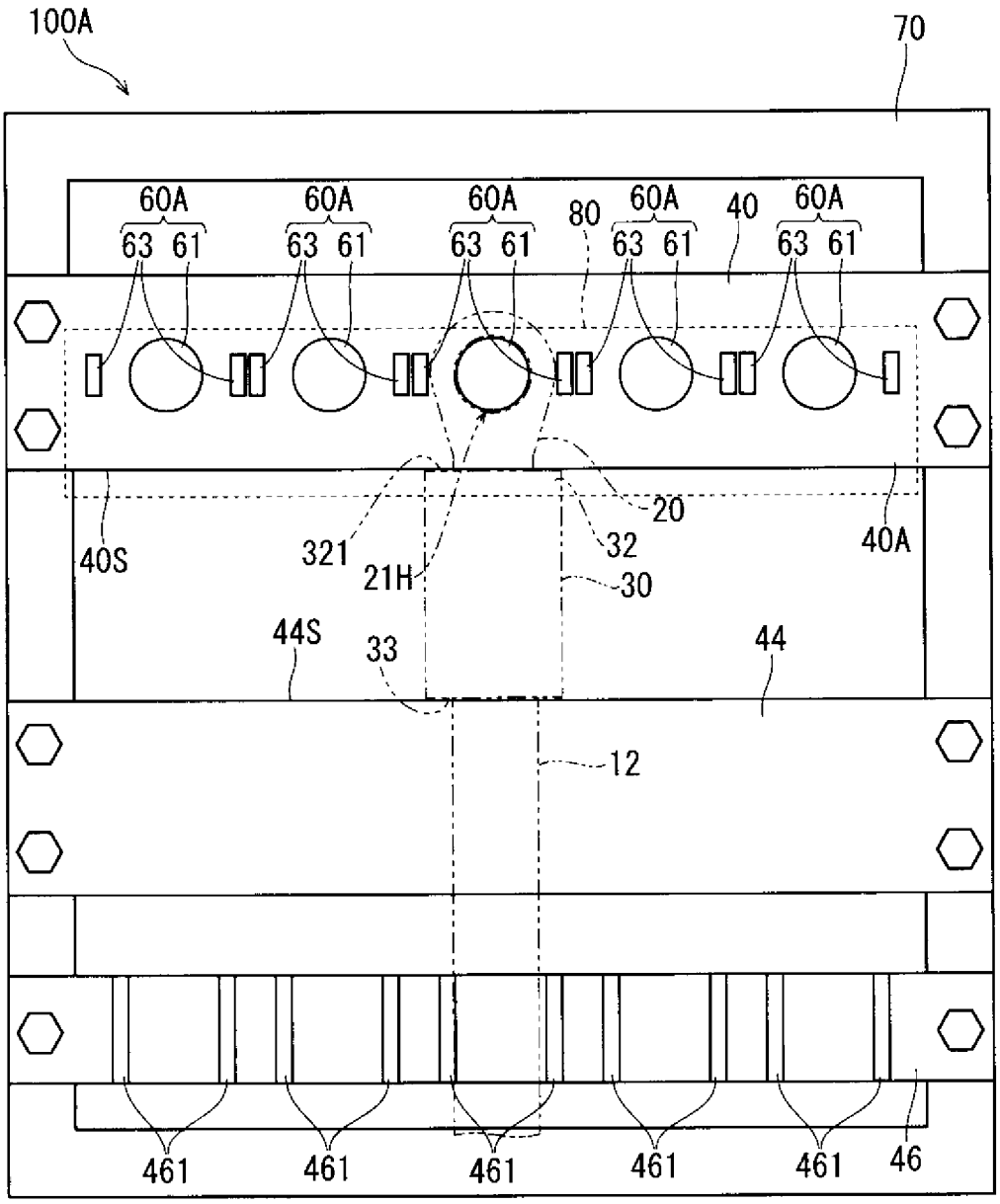
FIG. 9 is a schematic top view showing a heat-shrinkable tube fitting jig according to a second embodiment.

FIG. 9 is a schematic top view that shows a heat-shrinkable tube fitting jig 100A according to the second embodiment. The heat-shrinkable tube fitting jig 100A has an approximately identical configuration to that of the heat-shrinkable tube fitting jig 100. However, the heat-shrinkable tube fitting jig 100A differs from the heat-shrinkable tube fitting jig 100 by having a first side abutting plate 40A instead of the first side abutting plate 40.

Figure 10:
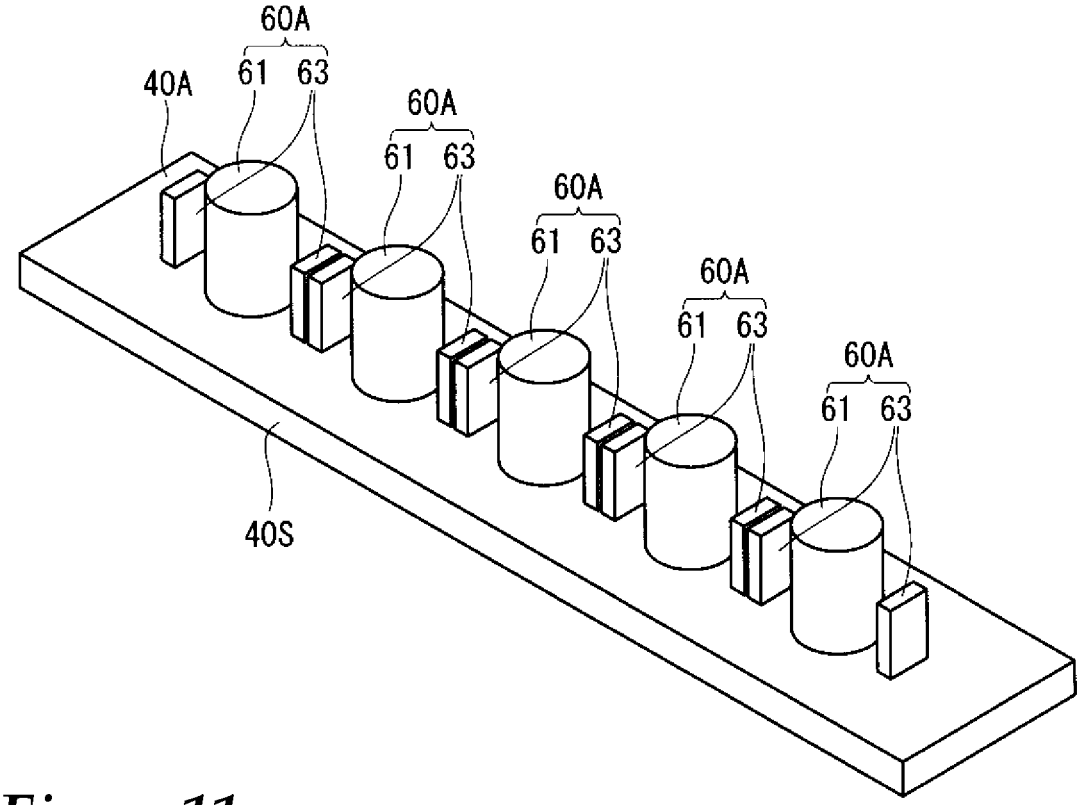
FIG. 10 is a schematic perspective view showing a first side abutting plate according to the second embodiment.

FIG. 10 is a schematic perspective view that shows the first side abutting plate 40A according to the second embodiment. A plurality of terminal positioning portions 60A are formed in parallel on the first side abutting plate 40A. Each of the terminal positioning portions 60A has a columnar body 61 and a pair of lugs 63 erected thereon. Each lug in a pair of lugs 63 is a substantially rectangular parallelepiped member. A columnar body 61 is provided between the pair of lugs 63.

As shown in FIG. 9, the pair of lugs 63 abut against the circumferential surface 213S of the earth portion 21 where the lugs pinch the earth portion 21, which is the counterpart connecting portion of the terminal 20. The pair of lugs 63 is an example of a pair of circumferential surface abutting portions that abut against the circumferential surface 213S. Providing such a pair of lugs 63 can prevent the earth portion 21 from rotating when fitted onto the columnar body 61. In this way, the terminal-attached electric wire 10 can be prevented from rotating.

Figure 11:
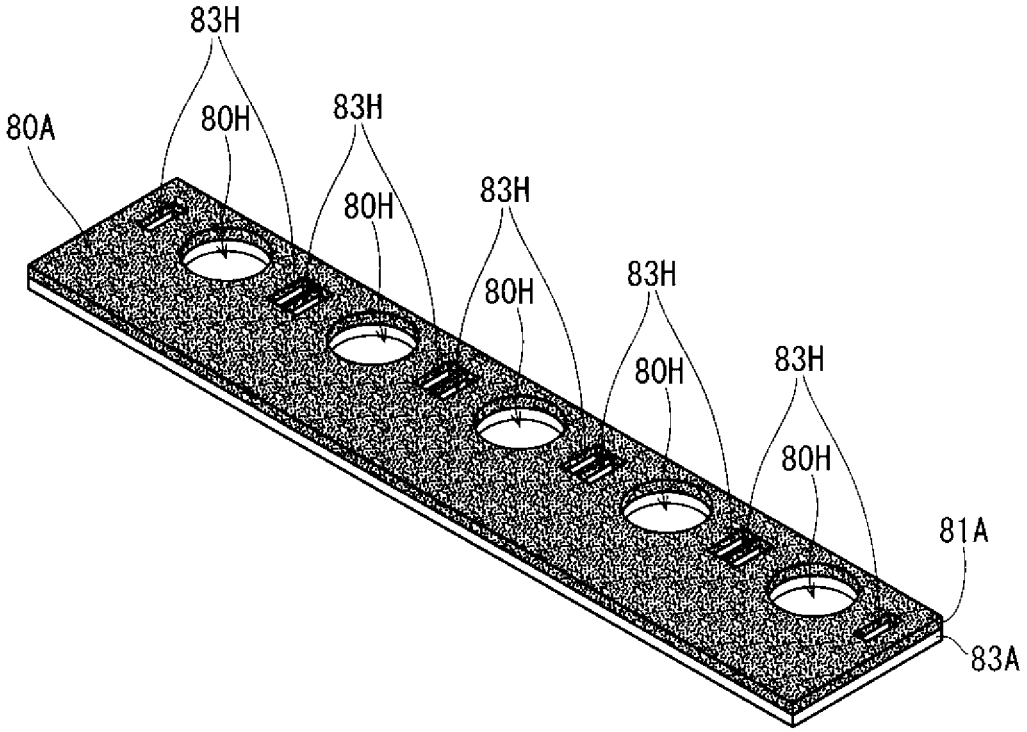
FIG. 11 is a schematic perspective view showing a hold-down member according to the second embodiment.

FIG. 11 is a schematic perspective view that shows a hold-down member 80A according to the second embodiment. Similar to the hold-down member 80, the hold-down member 80A is made of a steel plate 81A and a fluororesin plate 83A. As shown in FIG. 11, however, the hold-down member 80A has multiple sets of a through hole 80H formed therein that correspond to a columnar body 61 and a pair of through holes 83H that correspond to a pair of lugs 63.

By fitting the foregoing hold-down member 80A onto the heat-shrinkable tube fitting jig 100A, the first side ends 32 of the plurality of heat-shrinkable tubes 30 assembled to the heat-shrinkable tube fitting jig 100A can be held down.

Variations

Having described certain embodiments, the present invention is not limited to the foregoing and can be variously modified.

For example, as shown in FIG. 5, a fluororesin plate 90 may be provided that abuts against the first end face 321 of the heat-shrinkable tube 30 and the upper surface of the terminal 20 of the terminal-attached electric wire 10 assembled on the heat-shrinkable tube fitting jig 100. This can reduce the advance of the hot melt 31 over to the earth portion 21 side as it leaks out of the first side end 32 of the heat-shrinkable tube 30.

Additionally, according to the first embodiment, as shown in FIG. 5, the terminal-attached electric wire 10 is set on the heat-shrinkable tube fitting jig 100 so that the lower surface 211S of the terminal 20 abuts against the upper surface of the first side abutting plate 40. However, it may alternatively be assembled to a heat-shrinkable tube fitting jig in such a manner as to bring the upper surface of the terminal 20 (the side on which the core wire crimp portion 24 is provided) into abutment with the upper surface of the first side abutting plate. In this case, a recessed surface into which the terminal 20 can be fitted from above may be formed in the first side abutting plate.

It should be noted that any elements described with respect to the foregoing embodiments and variants may be combined or omitted as required as long as they are compatible with each other.

Having described the present design in detail, the foregoing description is illustrative in all aspects and the present invention is not limited thereto. It is understood that countless variants not illustrated herein are conceivable without departing from the scope of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

100, 100A Heat-shrinkable tube fitting jig
10 Terminal-attached electric wire
12 Electric wire
14 Core wire
14*a* Exposed core wire portion
20 Terminal
21 Earth portion (counterpart connecting portion)
21H Through hole
211S Lower surface
213S Circumferential surface
24 Core wire crimp portion
30 Heat-shrinkable tube
31 Hot melt (adhesive)
32 First side end
321 First end face
33 Second end face
40 First side abutting plate
40A First side abutting plate (first end face abutting portion)
40S First side abutting surface
44 Second side abutting plate (second end face abutting portion)
44S Second side abutting surface
46 Electric wire holding portion
60 Terminal positioning portion
60A Terminal positioning portion
61 Columnar body
62 Recessed surface
621 Bottom surface
623 Inner surface
63 Lug (circumferential surface abutting portion)
80, 80A Hold-down member
83, 83A Fluororesin plate

The invention claimed is:

1. A heat-shrinkable tube fitting jig used to fit a heat-shrinkable tube onto a terminal-attached electric wire in which a core wire crimp portion of a terminal is crimped onto an exposed core wire portion exposed from an electric wire, comprising:

a terminal positioning portion for positioning a counterpart connecting portion of a terminal of the terminal-attached electric wire, the terminal extending out of a first end of the heat-shrinkable tube;

a first end face abutting portion that abuts against a first end face of the heat-shrinkable tube that faces the counterpart connecting portion; and a second end face abutting portion that abuts against a second end face of the heat-shrinkable tube that is opposite to the first end face;

wherein the terminal positioning portion includes a columnar body erected on a plate member and capable of passing through a through hole formed in the counterpart connecting portion.

2. The heat-shrinkable tube fitting jig according to claim 1, wherein the first end face abutting portion closes at least a part of a gap between the heat-shrinkable tube and the terminal by abutting against the terminal from one of two main surfaces of the counterpart connecting portion and also against the first end face of the heat-shrinkable tube.

3. The heat-shrinkable tube fitting jig according to claim 1, wherein the terminal positioning portion includes a pair of circumferential surface abutting portions erected on the plate member and abutting against a circumferential surface of the counterpart connecting portion, at a position where the circumferential surface abutting portions pinch the counterpart connecting portion of the terminal.

4. The heat-shrinkable tube fitting jig according to claim 1, wherein the terminal positioning portion includes a recessed surface formed in the plate member, and the recessed surface includes a bottom surface that abuts against one of the two main surfaces of the counterpart connecting portion of the terminal, and an inner surface that abuts against a circumferential surface of the counterpart connecting portion of the terminal, the inner surface being a surface rising from the bottom surface.

5. The heat-shrinkable tube fitting jig according to claim 1 further comprising a hold-down member for holding down a first side end of the heat-shrinkable tube that is located on the counterpart connecting portion side.

6. The heat-shrinkable tube fitting jig according to claim 5, wherein at least a part of the hold-down member that comes into contact with the first side end includes an acetal resin or fluororesin.

7. The heat-shrinkable tube fitting jig according to claim 1 further comprising an electric wire holding portion for holding an electric wire that extends from a second end of the heat-shrinkable tube.

8. The heat-shrinkable tube fitting jig according to claim 1, wherein a plurality of the terminal positioning portions are formed in parallel on a single component.

* * * * *